US012471679B2

(12) United States Patent
Wang et al.

(10) Patent No.: US 12,471,679 B2
(45) Date of Patent: Nov. 18, 2025

(54) LACING DEVICE

(71) Applicant: SHISHI SENKE INTELLIGENT TECHNOLOGY CO., LTD., Quanzhou (CN)

(72) Inventors: Shanpao Wang, Quanzhou (CN); Shaofeng Chen, Quanzhou (CN); Huayun Yang, Quanzhou (CN)

(73) Assignee: SHISHI SENKE INTELLIGENT TECHNOLOGY CO., LTD., Quanzhou (CN)

( * ) Notice: Subject to any disclaimer, the term of this patent is extended or adjusted under 35 U.S.C. 154(b) by 0 days.

(21) Appl. No.: 19/238,174

(22) Filed: Jun. 13, 2025

(65) Prior Publication Data

US 2025/0302153 A1 Oct. 2, 2025

Related U.S. Application Data

(63) Continuation of application No. PCT/CN2024/125389, filed on Oct. 17, 2024.

(30) Foreign Application Priority Data

Oct. 25, 2023 (CN) ..... 202311388694.6

(51) Int. Cl.
*A43C 11/16* (2006.01)

(52) U.S. Cl.
CPC ..... *A43C 11/165* (2013.01)

(58) Field of Classification Search
CPC ..... A43C 11/165; A43C 7/00; A43C 7/04; A43C 7/005; A43C 11/20; A43C 11/00; A43C 11/16; Y10T 24/2183; Y10T 24/37
See application file for complete search history.

(56) References Cited

U.S. PATENT DOCUMENTS

| | | | | |
|---|---|---|---|---|
| 4,901,938 | A * | 2/1990 | Cantley | B65H 75/44 242/378.1 |
| 9,918,516 | B1 * | 3/2018 | Hall | A43C 11/20 |
| 10,842,230 | B2 * | 11/2020 | Pollack | B65H 75/4449 |
| 11,647,813 | B1 | 5/2023 | Rao | |
| 11,982,334 | B1 * | 5/2024 | Jiang | A43C 7/00 |

(Continued)

FOREIGN PATENT DOCUMENTS

| | | |
|---|---|---|
| CN | 116211025 A | 6/2023 |
| CN | 116509108 A | 8/2023 |
| CN | 117413997 A | 1/2024 |

*Primary Examiner* — Jason W San
*Assistant Examiner* — Rowland Do
(74) *Attorney, Agent, or Firm* — Nitin Kaushik

(57) ABSTRACT

A lacing device, including a main body, a winding wheel, an upper cover, and a ratchet mechanism. The winding wheel is rotatably arranged in the main body; the upper cover and the winding wheel can be connected or separated; the upper cover includes a cover body and a side wall arranged around the circumference of the cover body; there is a first meshing surface on an inner side surface of the side wall; two or more slide channels are formed in an upper end surface of the main body; the ratchet mechanism includes two or more sliding blocks sliding along the slide channels and an elastic member used for pushing the sliding blocks to slide towards the outside of the main body; and each sliding block is provided with a first ratchet tooth fitted with the first meshing surface to achieve engagement.

8 Claims, 10 Drawing Sheets

(56) References Cited

U.S. PATENT DOCUMENTS

| | | | | |
|---|---|---|---|---|
| 12,150,525 | B1 * | 11/2024 | Kruse | A43C 11/165 |
| 2012/0228419 | A1 * | 9/2012 | Chen | A43C 11/165 242/395 |
| 2015/0076272 | A1 * | 3/2015 | Trudel | A43C 11/165 242/381.4 |
| 2017/0303643 | A1 * | 10/2017 | Converse | A43C 11/00 |
| 2019/0008236 | A1 * | 1/2019 | Ha | A43C 11/165 |
| 2019/0174869 | A1 * | 6/2019 | Wang | B65H 75/26 |
| 2019/0343235 | A1 * | 11/2019 | So | A43C 7/08 |
| 2020/0087104 | A1 * | 3/2020 | Wang | B65H 75/4415 |
| 2020/0346888 | A1 * | 11/2020 | Kruse | A43B 23/0205 |
| 2023/0234809 | A1 * | 7/2023 | Huang | B65H 75/4492 242/395 |
| 2023/0248116 | A1 * | 8/2023 | Duller | A43C 11/165 24/68 SK |
| 2024/0035546 | A1 * | 2/2024 | Tasi | F16G 11/12 |
| 2024/0417213 | A1 * | 12/2024 | Huang | A43C 11/165 |

* cited by examiner

LACING DEVICE

CROSS-REFERENCE TO RELATED APPLICATIONS

The application claims priority to Chinese patent application No. 202311388694.6, filed on Oct. 25, 2023, the entire contents of which are incorporated herein by reference.

TECHNICAL FIELD

The present invention relates to the field of lace twisting for releasing or fastening, in particular to a lacing device.

BACKGROUND

At present, the Chinese patent No. 202320155870.0 has disclosed a novel lace twisting device for releasing or fastening and a ratchet mechanism thereof. The novel lace twisting device for releasing or fastening includes a seat body, a line wheel, and a twisting member, wherein the line wheel is embedded in the seat body, the twisting member is connected to the seat body, and tooth slots are distributed in the seat body; the twisting member includes a wheel disc rigid assembly on which protruding teeth are distributed, the tooth slots and the protruding teeth are meshed in a structure of meshing up and down, which is a structure capable of realizing one-way ratchet rotation, and the line wheel and the twisting member are provided with a driving structure capable of realizing connection driving or separating movement; and when the twisting member moves relative to the seat body, a meshed fastening mode in which the tooth slots are meshed with the protruding teeth and a free lace releasing mode in which the tooth slots are separated from the protruding teeth can be achieved.

At present, there have been various kinds of twisting devices for releasing or fastening on the market, some of them are complex in structure so as not to be conducive to the development and production for universal application, and some of them are low in structural design strength, short in service life and poor in fastening hand feeling. In order to achieve a structure having good structural stability, relatively high strength and relatively long service life, an existing structure is correspondingly improved by the present applicant.

SUMMARY

Therefore, for solving the above-mentioned problems, the present invention provides a lacing device by which the technical problems of poor stability, low strength and short service life of an existing lacing device are solved.

In order to achieve the above-mentioned object, adopted in the present invention is the following technical solution: provided is a lacing device, including a main body, a winding wheel used for winding a lace, an upper cover rotatably arranged on the main body, and a ratchet mechanism used for realizing one-way rotation of the upper cover, wherein the winding wheel is rotatably arranged in the main body, and the upper cover and the winding wheel can be connected or separated;

the upper cover includes a cover body and a side wall arranged around the circumference of the cover body, and there is a first meshing surface on an inner side surface of the side wall;

two or more slide channels are formed in an upper end surface of the main body;

the ratchet mechanism includes two or more sliding blocks sliding along the slide channels and an elastic member used for pushing the sliding blocks to slide towards the outside of the main body, and each sliding block is provided with a first ratchet tooth fitted with the first meshing surface to achieve engagement; and when the upper cover is connected with the winding wheel, the first ratchet tooth is nested and engaged with the first meshing surface, when the upper cover rotates forwards, the first meshing surface presses against the first ratchet tooth to push the sliding blocks to slide along the slide channels, and then to press the elastic member to deform, and finally, each ratchet tooth enters the next first meshing surface, and when the upper cover rotates reversely, the first meshing surface is locked by the first ratchet tooth so that the sliding blocks cannot be pushed to slide along the slide channels Further, the elastic member is an annular body arranged above the main body, each sliding block is arranged on the annular body, and a curved energy storage part used for strengthening elastic properties is arranged between two adjacent sliding blocks on the annular body.

Further, three sliding blocks are provided, the three sliding blocks are uniformly spaced, an intersection point is formed between a first side line of each sliding block in a clockwise direction and an outer circumference of the main body, the intersection point forms a main body connecting line with the center of the main body, and an included angle formed by the first side line and the main body connecting line is 30° to 60°.

Further, each of the slide channels is composed of two stop block structures, and each stop block structure is further provided with a channel engagement housing used for engaging the sliding blocks.

Further, two or more limiting clamping blocks are arranged on a lower end of a side wall of the upper cover, a clamping ring is arranged on an upper part of a side surface of the main body, the limiting clamping blocks are engaged on a lower end of the clamping ring, a third through hole is formed in the middle of an upper end of the main body, a transmission disc is clamped in the middle of the upper cover, second transmission teeth are arranged on a lower end of the transmission disc, second transmission slots are formed in an upper end surface of the winding wheel, the upper cover moves up and down along the main body to realize clutch fit between the second transmission teeth and the second transmission slots, and then to realize clutch fit between the upper cover and the winding wheel, and the main body is provided with a limiting structure used for limiting an up-and-down movement position of the upper cover.

Further, a first through hole is formed in the middle of the winding wheel, a second through hole is formed in the middle of the transmission disc, the limiting structure includes a bottom plate and a clamping pin arranged in the middle of the bottom plate, the bottom plate is clamped on a lower end of the main body, the clamping pin penetrates through the first through hole and the second through hole, a limiting protrusion is arranged on the side wall on an upper end of the clamping pin, when the upper cover drives the transmission disc to move downwards to be connected with the winding wheel, the second through hole is engaged in a lower end of the limiting protrusion, and when the upper cover drives the transmission disc to move upwards to be separated from the winding wheel, the second through hole is engaged in an upper end of the limiting protrusion.

Further, an elastic deformation slot is formed in the middle of the clamping pin, and when the limiting protrusion penetrates through the second through hole, the elastic deformation slot realizes penetration by deformation.

Provided is a lacing device based on the same inventive concept, including a main body, a winding wheel used for winding a lace, an upper cover rotatably arranged on the main body, and a ratchet mechanism used for realizing one-way rotation of the upper cover, wherein the winding wheel is rotatably arranged in the main body, and the upper cover and the winding wheel can be connected or separated; wherein the upper cover includes a cover body and a side wall arranged around the circumference of the cover body, and there is a first meshing surface on an inner side surface of the side wall;

two or more slide channels are formed in an upper end surface of the main body;

the ratchet mechanism includes two or more sliding blocks sliding along the slide channels and an elastic member used for pushing the sliding blocks to slide towards the outside of the main body, and each sliding block is provided with a first ratchet tooth fitted with the first meshing surface to achieve engagement;

when the upper cover is connected with the winding wheel, the first ratchet tooth is nested and engaged with the first meshing surface, when the upper cover rotates forwards, the first meshing surface presses against the first ratchet tooth to push the sliding blocks to slide along the slide channels, and then to press the elastic member to deform, and finally, each ratchet tooth enters the next first meshing surface, and when the upper cover rotates reversely, the first meshing surface is locked by the first ratchet tooth so that the sliding blocks cannot be pushed to slide along the slide channels; and a base is further included, the main body is detachably arranged on the base, the base is provided with a mounting cavity, the mounting cavity is internally provided with a torsional spring, the mounting cavity is internally provided with a rotating disc located between the torsional spring and the winding wheel, two ends of the torsional spring are respectively connected with the rotating disc and the base, the rotating disc is provided with elastic sheets, and third transmission slots fitted with the elastic sheets are formed in a lower end surface of the winding wheel; when the upper cover drives the winding wheel to rotate forwards, the winding wheel does not drive the rotating disc to rotate; and when the upper cover is disconnected with the winding wheel, the torsional spring releases energy to drive the rotating disc to rotate forwards, and then to drive the winding wheel to rotate forwards, so that the lace is partially or entirely recycled.

By adopting the aforesaid technical solution, the present invention has the beneficial effects that:

1, in the present solution, by arranging the ratchet mechanism, a more stable ratchet can be achieved, and the ratchet mechanism is higher in engagement strength and longer in service life. By arranging the slide channels, the sliding blocks, and the elastic member, the fit between the first ratchet tooth and the first meshing surface can be realized, and due to more restrictions of the fit, stronger stability is achieved. Forward rotation can be clockwise or anticlockwise, which is a rotation direction when the lace is fastened, and correspondingly, reverse rotation is opposite to that. The channels descried herein are not arranged in a radial direction, but are arranged at a certain deviation angle, such deviation aims at pressing the sliding blocks to rapidly enter the slide channels during forward rotation and also ensuring that engagement can be effectively achieved during reverse rotation, and the sliding blocks are placed into the slide channels. In conventional setting, it is the best that the deviation angle is 30-60°.

2. In order to better reduce the cost and provide elastic properties, the elastic member is an annular body arranged above the main body, each sliding block is arranged on the annular body, and a curved energy storage part used for strengthening elastic properties is arranged between two adjacent sliding blocks on the annular body, wherein a connection part between each sliding block and the annular body can be only a smaller part, which is more conducive to the deformation of the annular body; and the curved energy storage part is arranged to absorb deformation energy and release the energy, which is conducive to the prolonging of the service life. In the present solution, the annular body, the sliding blocks and the curved energy storage part are made by integrated molding, and are made of a plastic or nylon material having better deformation restoration properties.

3. By arranging the channel grooves and the channel engagement housing, the stable slide of the sliding blocks can be realized.

4. By arranging the transmission disc, the third through hole, the second transmission teeth, and the second transmission slots, the upper cover can move up and down to realize clutch fit between the second transmission teeth and the second transmission slots, and then to realize clutch fit between the upper cover and the winding wheel; and by arranging the limiting structure, the upper cover can be in a stable state when the clutch fit between the upper cover and the winding wheel is realized. That is, when the upper cover drives the transmission disc to move downwards to be connected with the winding wheel, the second through hole is engaged in a lower end of the limiting protrusion, and when the upper cover drives the transmission disc to move upwards to be separated from the winding wheel, the second through hole is engaged in an upper end of the limiting protrusion. Thus, relatively stable clutch fit can be realized.

5. The lacing device based on the same inventive concept is additionally provided with the base and is further provided with the torsional spring and the rotating disc. By arranging the elastic sheets and the third transmission slots, when the upper cover drives the winding wheel to rotate forwards, the winding wheel does not drive the rotating disc to rotate, and during reverse rotation, the rotating disc can be driven to rotate reversely. In a lace fastening mode, the upper cover is connected and fitted with the winding wheel, and due to the existence of the ratchet mechanism, the upper cover can only rotate forwards to drive the winding wheel to fasten the lace, and can stop rotating to lock the lace; and in a lace releasing mode, the upper cover is disconnected with the winding wheel, the ratchet mechanism is out of fit, the lace can be drawn out and released to drive the winding wheel to rotate reversely, and then to drive the rotating disc to rotate, the torsional spring stores energy, the lace is released, and the torsional spring releases energy to drive the rotating disc to rotate forwards, and then to drive the winding wheel to rotate forwards, so that the lace can also be partially or entirely recycled in the releasing mode.

If the lacing device is used on a shoe, when the upper cover is disconnected with the winding wheel, a shoelace is still in a semi-fastened state due to the existence of the torsional spring, at the time, the semi-fastened state is not locked, the shoelace can freely stretch, a foot can be freely separated from the shoe, and when the shoe is worn for the second time, the shoelace is stretched and released with a hand so as to be penetrated. The stretched shoelace will be automatically taken back into the device, and then is locked by pressing, so that it is more convenient, time-saving and labor-saving during lacing the shoe for wearing.

Figure 1:
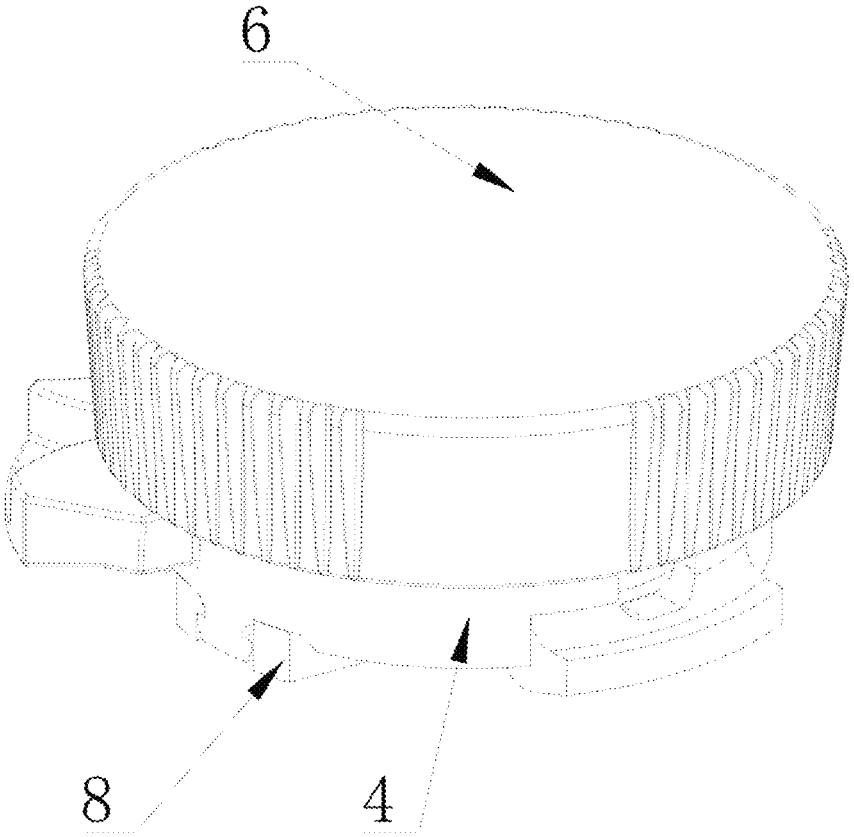
FIG. 1 is a schematic diagram of a three-dimensional structure of an obverse side in the present invention.
Figure 2:
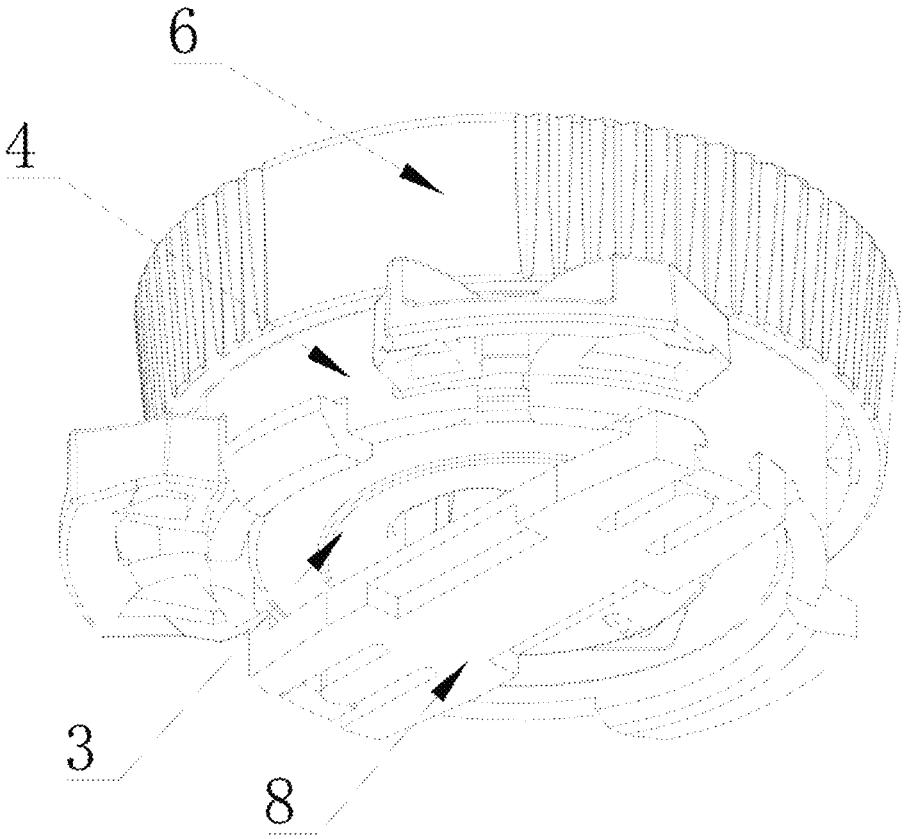
FIG. 2 is a schematic diagram of a three-dimensional structure of a reverse side in the present invention.
Figure 3:
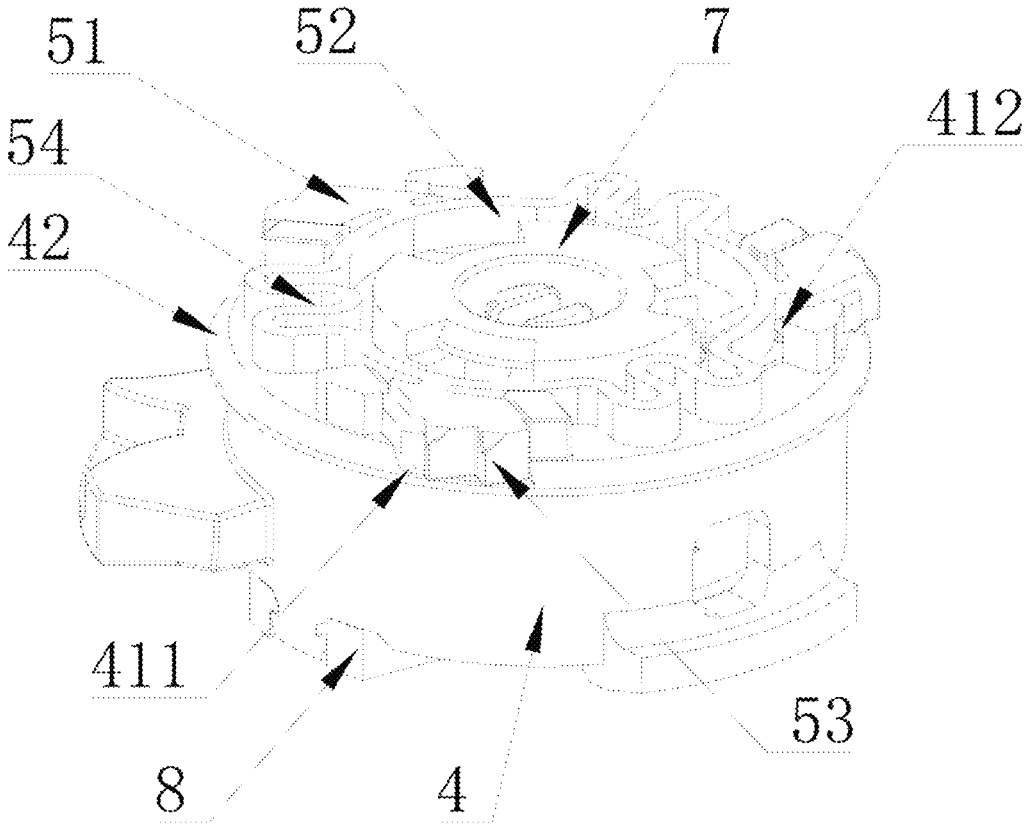
FIG. 3 is a schematic diagram of a three-dimensional structure with a cover body being omitted in the present invention.

Reference numerals in the accompanying drawings:

1, base; 11, mounting cavity; 12, torsional spring; 13, mounting column;

2, rotating disc; 21, elastic sheet; 22, disc wall; 23, notch; 24, clamping column;

3, winding wheel; 31, second transmission slot; 32, first through hole; 33, third transmission slot; 34, step part;

4, main body; 41, slide channel; 411, channel groove; 412, channel engagement housing; 42, clamping ring; 43, third through hole;

5, ratchet mechanism; 51, sliding block; 52, elastic member; 53, first ratchet tooth; 54, curved energy storage part;

6, upper cover; 61, cover body; 62, side wall; 63, first meshing surface; 64, limiting clamping block;

7, transmission disc; 71, second transmission tooth, 72, second through hole;

8, limiting structure; 81, bottom plate; 82, clamping pin; 83, limiting protrusion; and 84, elastic deformation slot.

DETAILED DESCRIPTION OF THE EMBODIMENTS

The present invention will now be further described in conjunction with the accompanying drawings and specific implementations.

Referring to FIG. 1 to FIG. 8, the present embodiment 1 provides a lacing device, including a main body 4, a winding wheel 3 used for winding a lace, an upper cover 6 rotatably arranged on the main body 4, and a ratchet mechanism 5 used for realizing one-way rotation of the upper cover 6, wherein the winding wheel 3 is rotatably arranged in the main body 4, and the upper cover 6 and the winding wheel 3 can be connected or separated; the upper cover 6 includes a cover body 61 and a side wall 62 arranged around the circumference of the cover body 61, and there is a first meshing surface 63 on an inner side surface of the side wall 62; and two or more slide channels 41 are formed in an upper end surface of the main body 4.

Figure 4:
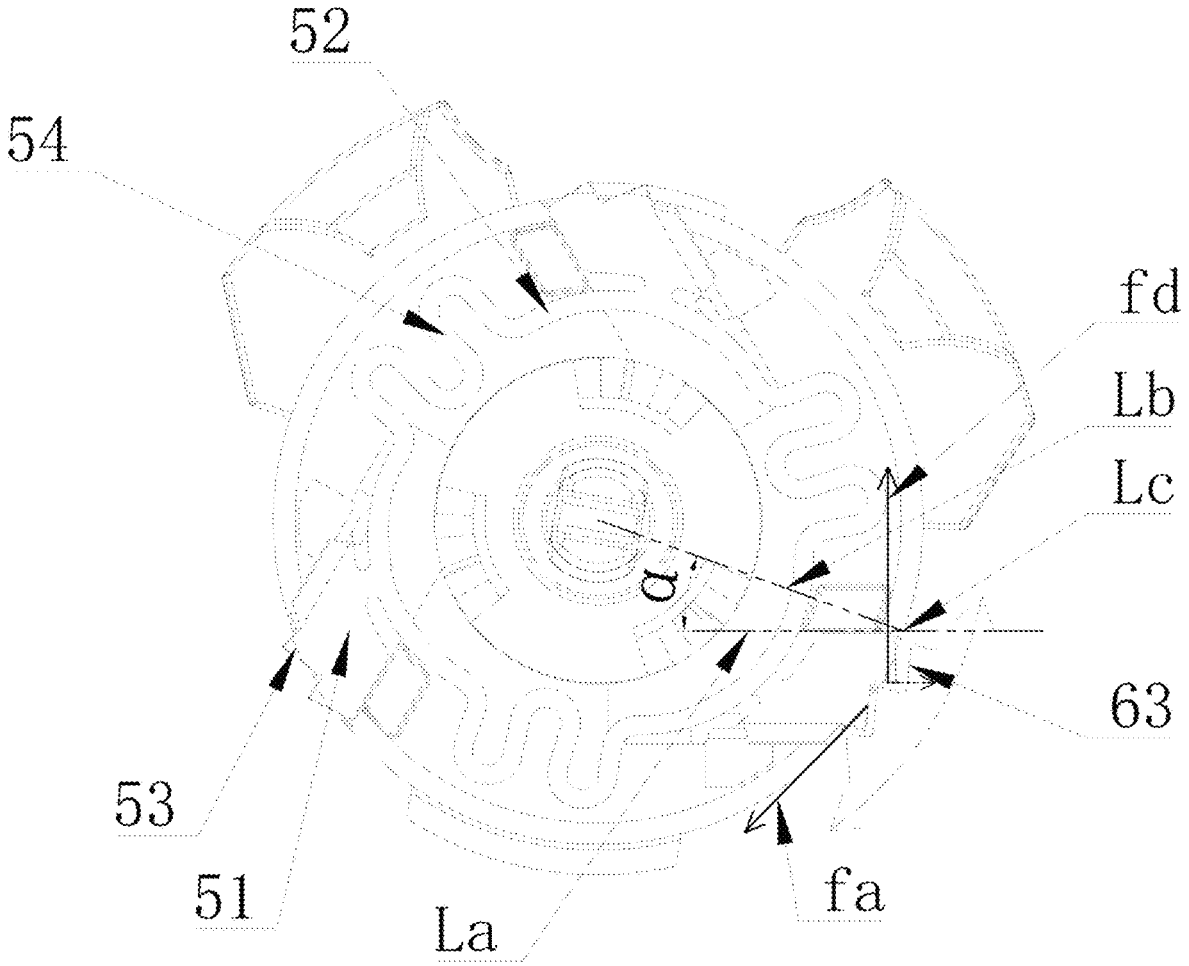
FIG. 4 is a top view of FIG. 3.
Figure 5:
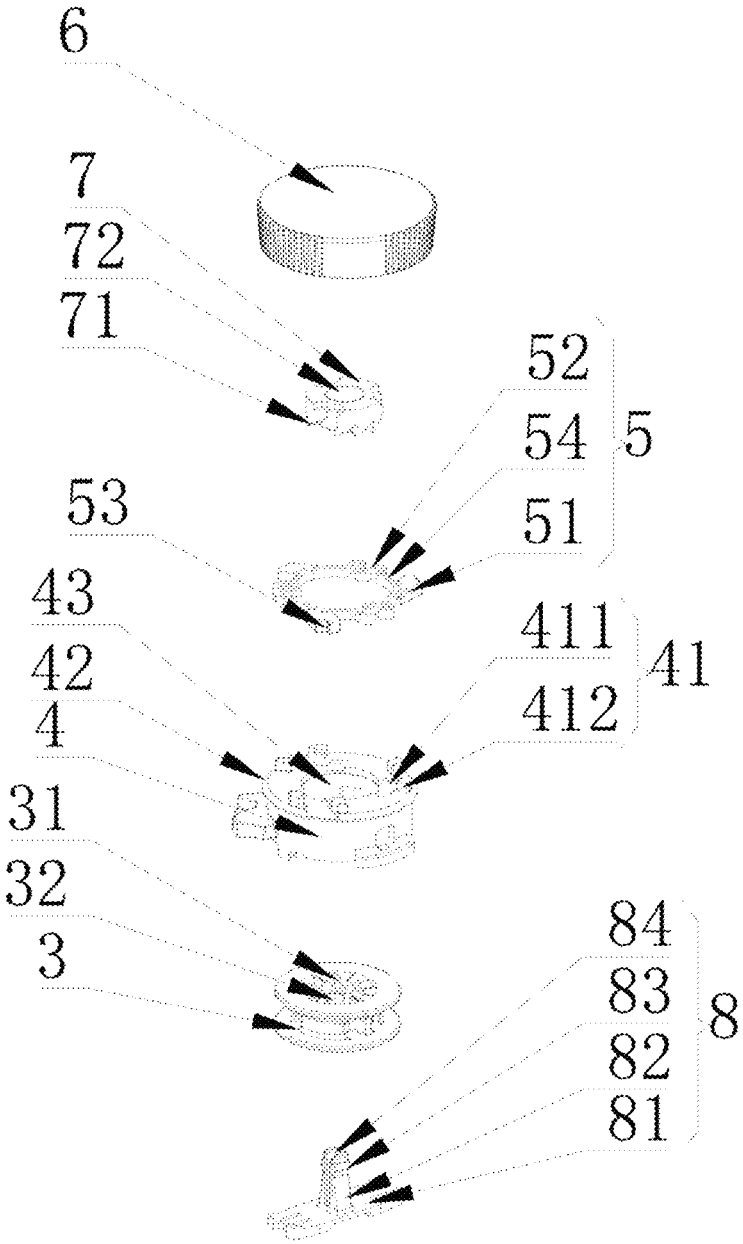
FIG. 5 is a schematic diagram of an exploded structure of FIG. 1.
Figure 6:
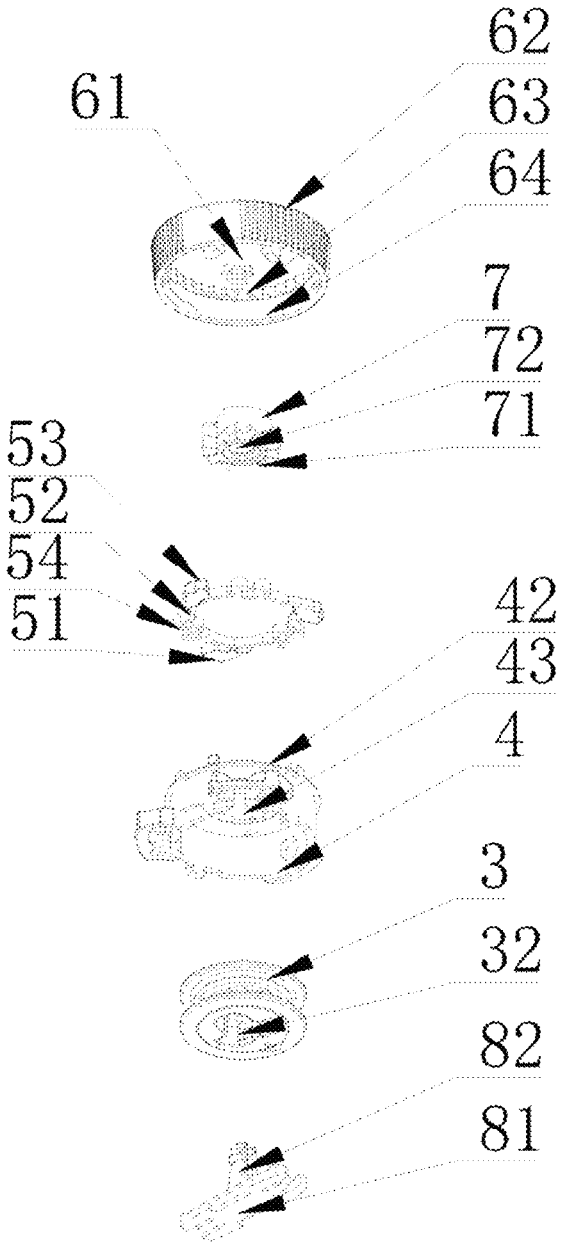
FIG. 6 is a schematic diagram of an exploded structure of FIG. 2.
Figure 7:
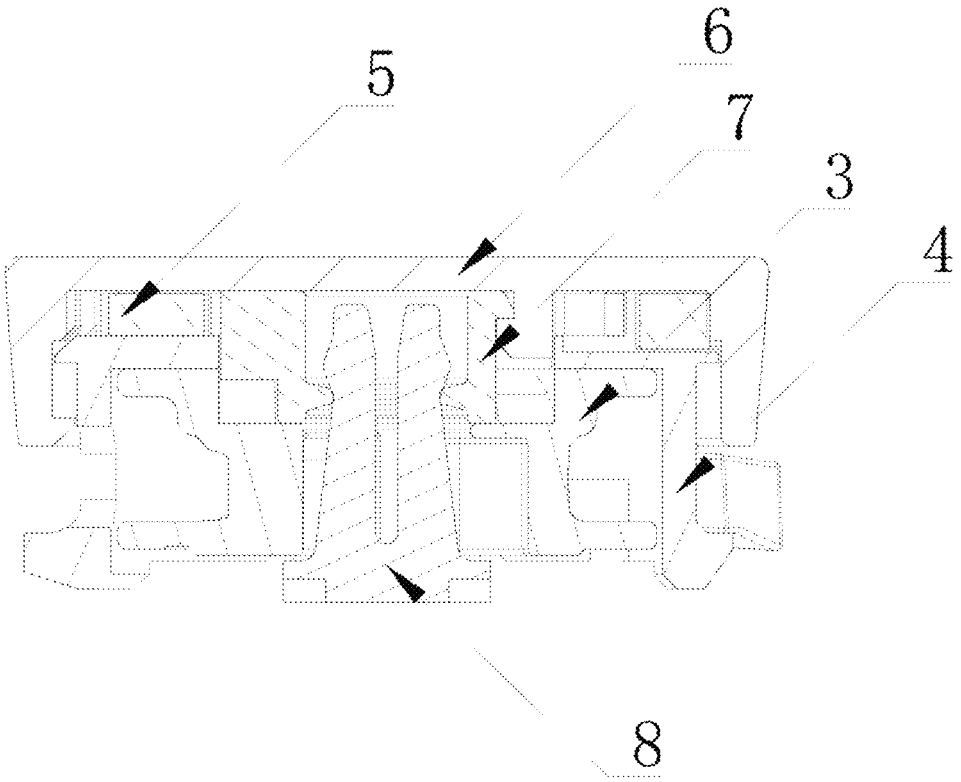
FIG. 7 is a schematic diagram of a sectional structure in the present invention.

The ratchet mechanism 5 includes two or more sliding blocks 51 sliding along the slide channels 41 and an elastic member 52 used for pushing the sliding blocks 51 to slide towards the outside of the main body 4, and each sliding block 51 is provided with a first ratchet tooth 53 fitted with the first meshing surface 63 to achieve engagement. The elastic member 52 is an annular body arranged above the main body 4, each sliding block 51 is arranged on the annular body, and a curved energy storage part 54 used for strengthening elastic properties is arranged between two adjacent sliding blocks 51 on the annular body. Three sliding blocks 51 are provided, as shown in FIG. 4, a first side line La of each sliding block extends to form an intersection point Lc with an outer circumferential line of the main body, the intersection point Lc and the center of a circle of an outer circumference of the main body are connected to form a main body connecting line Lb, an included angle formed by the first side line and the main body connecting line is 30° to 60°, and such an included angle aims at better pressing the sliding blocks into the slide channels during forward rotation and also ensuring that engagement can be effectively achieved during reverse rotation. In the present solution, the angle $\alpha$ is set as 45°.

Each of the slide channels 41 is composed of two stop block structures, and each stop block structure is further provided with a channel engagement housing 412 used for engaging the sliding blocks. In order to realize better slide, channel grooves 411 are further arranged, of course, the channel engagement housing 412 can also be a stop block or be shaped like an inverted L.

When the upper cover 6 is connected with the winding wheel 3, the first ratchet tooth 53 is nested and engaged with the first meshing surface 63, when the upper cover 6 rotates forwards, the first meshing surface 63 presses against the first ratchet tooth 53 to push the sliding blocks 51 to slide along the slide channels 41, and then to press the elastic member 52 to deform, and finally, each ratchet tooth 53 enters the next first meshing surface 63; when the upper cover 6 rotates reversely, the first meshing surface 63 is locked by the first ratchet tooth 53 so that the sliding blocks 51 cannot be pushed to slide along the slide channels 41.

Figure 8:
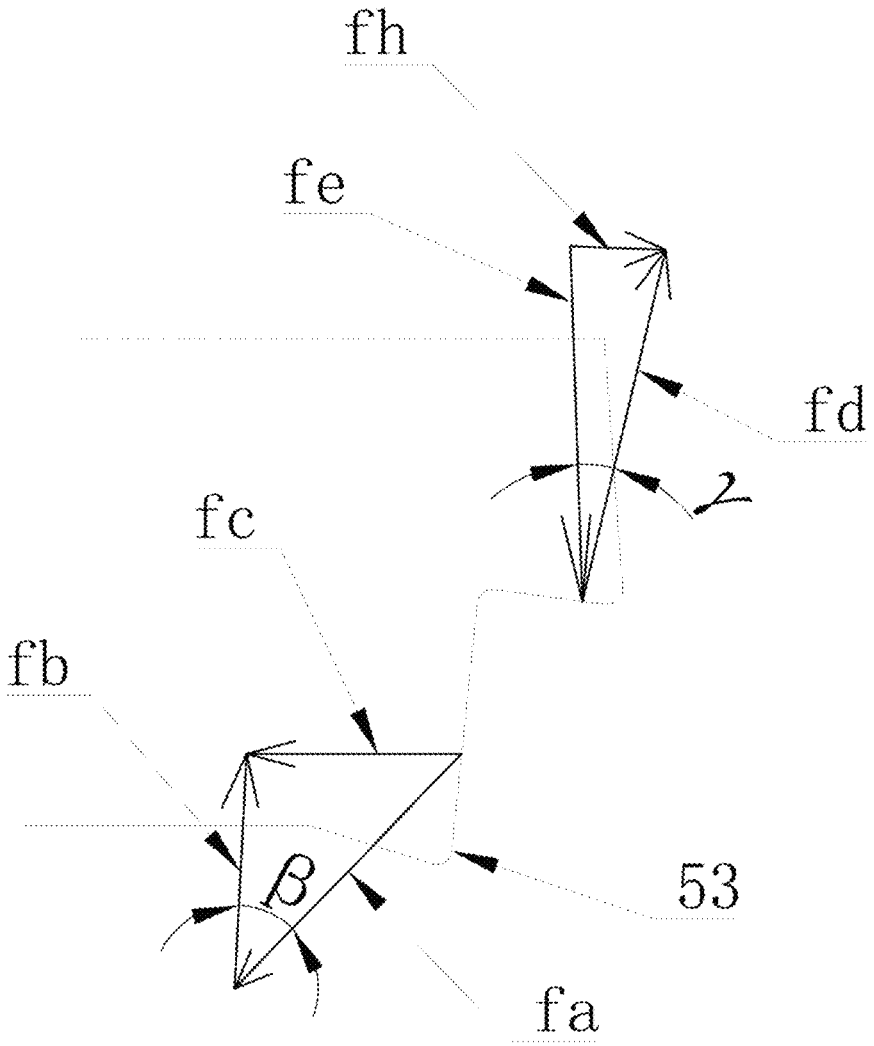
FIG. 8 is a schematic diagram of the resolution of a force in FIG. 4.

Further referring to FIG. 8, when the upper cover 6 rotates forwards, the first meshing surface applies a twisting force Fa to the first ratchet teeth of the sliding blocks, a counter force Fb for the first ratchet teeth is formed on a side normal position of the stop block at one side of the slide channels, and an included angle $\beta$ is formed; and according to a triangle law, for the resultant of two forces, a direction of a resultant force is pointed from a starting point of a first force to an ending point of a second force, an inward resultant force Fc will be generated between them under impacts of this force, the direction of the inward resultant force induces the slides blocks to retract inwards into the channels, and the rotary cover can normally rotate.

When the upper cover 6 rotates reversely, the first meshing surface applies a twisting force fd to the first ratchet teeth of the sliding blocks, a counter force fe for the first ratchet teeth is formed on a side normal position of the stop block at one side of the slide channels, and an included angle γ is formed; and according to a triangle law, for the resultant of two forces, a direction of a resultant force is pointed from a starting point of a first force to an ending point of a second force, an outward resultant force fh will be generated between them under impacts of this force, the direction of the outward resultant force induces the slides blocks to slide outwards, however, the sliding blocks are correspondingly and directly pushed and cannot further slide outwards under the blocking of the first meshing surface, which results in incapability of reverse rotation of the upper cover, and thus, sudden release of the lace under the action of a releasing force is avoided.

Two or more limiting clamping blocks 64 are arranged on a lower end of the side wall 62 of the upper cover 6, a clamping ring 42 is arranged on an upper part of a side surface of the main body 4, the limiting clamping blocks 64 are engaged on a lower end of the clamping ring 42, a third through hole 43 is formed in the middle of an upper end of the main body 4, a transmission disc 7 is clamped in the middle of the upper cover 6, second transmission teeth 71 are arranged on a lower end of the transmission disc 7, second transmission slots 31 are formed in an upper end surface of the winding wheel 3, the upper cover 6 moves up and down along the main body 4 to realize clutch fit between the second transmission teeth 71 and the second transmission slots 31, and then to realize clutch fit between the upper cover 6 and the winding wheel 3, and the main body 4 is provided with a limiting structure 8 used for limiting an up-and-down movement position of the upper cover 6.

A first through hole 32 is formed in the middle of the winding wheel 3, a second through hole 72 is formed in the middle of the transmission disc 7, the limiting structure 8 includes a bottom plate 81 and a clamping pin 82 arranged in the middle of the bottom plate 81, the bottom plate 81 is clamped on a lower end of the main body 4, the clamping pin 82 penetrates through the first through hole 32 and the second through hole 72, a limiting protrusion 83 is arranged on the side wall 62 on an upper end of the clamping pin 82, when the upper cover 6 drives the transmission disc 7 to move downwards to be connected with the winding wheel 3, the second through hole 72 is engaged in a lower end of the limiting protrusion 83, and when the upper cover 6 drives the transmission disc 7 to move upwards to be separated from the winding wheel 3, the second through hole 72 is engaged in an upper end of the limiting protrusion 83. An elastic deformation slot 84 is formed in the middle of the clamping pin 82, and when the limiting protrusion 83 penetrates through the second through hole 72, the elastic deformation slot 84 realizes penetration by deformation.

Figure 9:
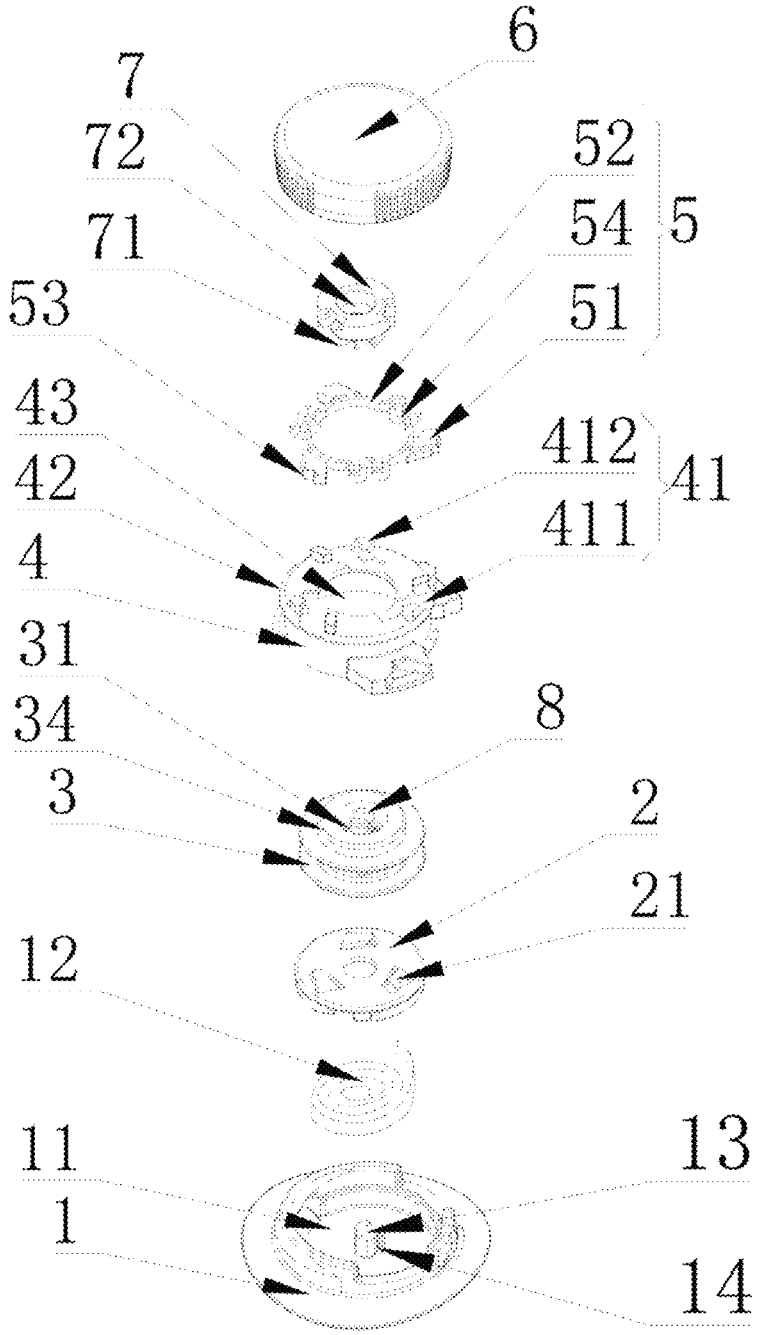
FIG. 9 is a schematic diagram of an exploded structure viewed at a first viewing angle in another implementation of the present invention.
Figure 10:
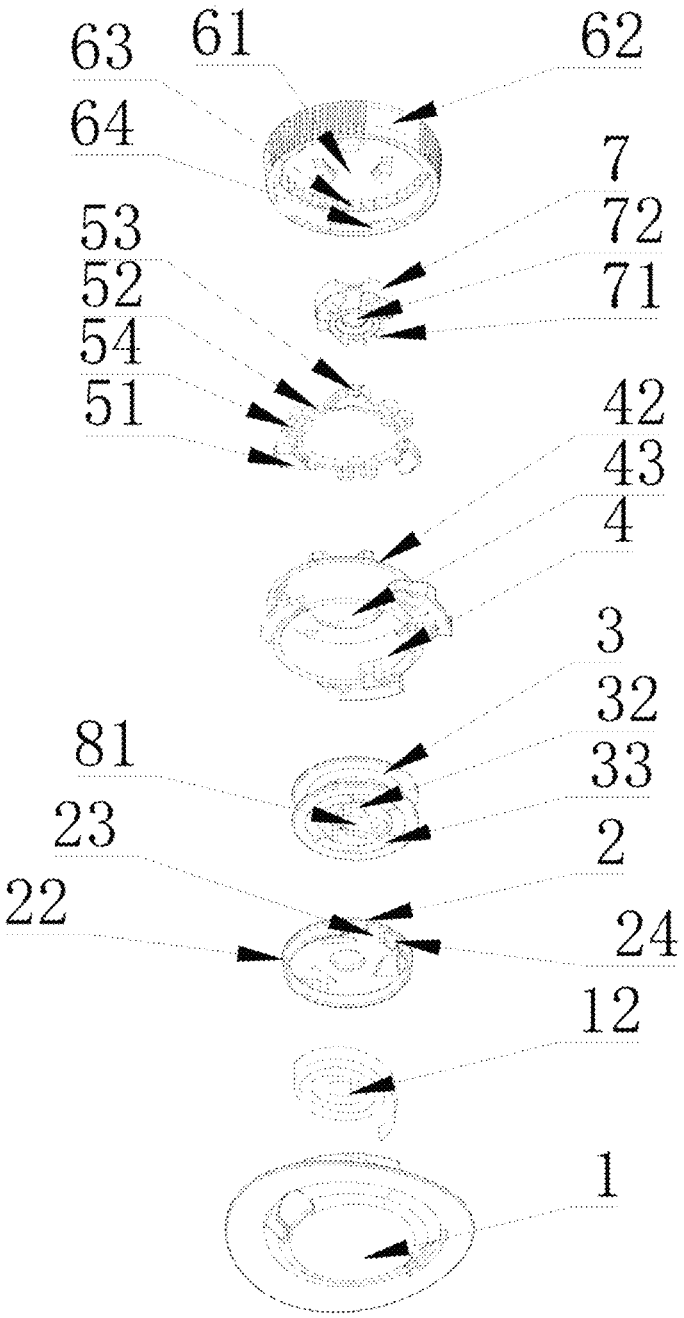
FIG. 10 is a schematic diagram of an exploded structure viewed at a second viewing angle in another implementation of the present invention.

Further referring to FIG. 9 and FIG. 10, the present embodiment 2 provides a lacing device based on the same inventive concept, which differs from embodiment 1 in that:

a base 1 is further included, the main body 4 is detachably arranged on the base 1, the base 1 is provided with a mounting cavity 11, the mounting cavity 11 is internally provided with a torsional spring 12, the mounting cavity 11 is internally provided with a rotating disc 2 located between the torsional spring 12 and the winding wheel 3, two ends of the torsional spring are respectively connected with the rotating disc 2 and the base 1, the rotating disc 2 is provided with elastic sheets 21, and third transmission slots 33 fitted with the elastic sheets 21 are formed in a lower end surface of the winding wheel 3; when the upper cover 6 drives the winding wheel 3 to rotate forwards, the winding wheel 3 does not drive the rotating disc 2 to rotate; and when the upper cover 6 is disconnected with the winding wheel 3, if the lace is drawn out, the torsional spring 12 will store energy, and if the lace is released, the torsional spring 12 releases energy to drive the rotating disc 2 to rotate forwards, and then to drive the winding wheel 3 to rotate forwards, so that the lace is partially or entirely recycled.

A mounting column 13 is arranged in the middle of the base 1, one end of the torsional spring 12 is engaged on the mounting column 13, and the mounting column 13 is provided with engagement forks 14. A disc wall 22 is arranged downwards on a circumferential side surface of the rotating disc 2, the disc wall 22 is provided with a notch 23 used for engaging the torsional spring 12, the notch 23 is provided with a clamping column 24 used for clamping the torsional spring 12, and the torsional spring 12 is located in the disc wall 22.

A step part 34 is arranged on an upper end of the winding wheel 3, and the step part 34 extends into the third through hole 43 to realize the rotary support of the winding wheel 3.

The bottom plate 81 of the limiting structure 8 is fixedly connected to a lower end of the winding wheel 3.

The present invention has the beneficial effects that:

1. in the present solution, by arranging the ratchet mechanism, a more stable ratchet can be achieved, and the ratchet mechanism is higher in engagement strength and longer in service life. By arranging the slide channels, the sliding blocks, and the elastic member, the fit between the first ratchet tooth and the first meshing surface can be realized, and due to more restrictions of the fit, stronger stability is achieved. Forward rotation can be clockwise or anticlockwise, which is a rotation direction when the lace is fastened, and correspondingly, reverse rotation is opposite to that. The channels descried herein are not arranged in a radial direction, but are arranged at a certain deviation angle, such deviation aims at pressing the sliding blocks to rapidly enter the slide channels during forward rotation and also ensuring that engagement can be effectively achieved during reverse rotation, and the sliding blocks are placed into the slide channels. In conventional setting, it is the best that the deviation angle is 30-60°. That is, when the upper cover rotates forwards, the first meshing surface applies a twisting force Fa to the first ratchet teeth of the sliding blocks, a counter force Fb for the first ratchet teeth is formed on a side normal position of a stop block at one side of the slide channels, and an included angle β is formed; and according to a triangle law, for the resultant of two forces, a direction of a resultant force is pointed from a starting point of a first force to an ending point of a second force, an inward resultant force Fc will be generated between them under impacts of this force. When the upper cover rotates reversely, the first meshing surface applies a twisting force fa to the first ratchet teeth of the sliding blocks, a counter force fb for the first ratchet teeth is formed on a side normal position of a stop block at one side of the slide channels, and an included angle α is formed; and according to a triangle law, for the resultant of two forces, a direction of a resultant force is pointed from a starting point of a first force to an ending point of a second force, an outward resultant force fc will be generated between them under impacts of this force.

2. In order to better reduce the cost and provide elastic properties, the elastic member is an annular body arranged above the main body, each sliding block is arranged on the annular body, and a curved energy storage part used for strengthening elastic properties is arranged between two adjacent sliding blocks on the annular body, wherein a connection part between each sliding block and the annular body can be only a smaller part, which is more conducive to the deformation of the annular body; and the curved energy storage part is arranged to absorb deformation energy and release the energy, which is conducive to the prolonging of the service life. In the present solution, the annular body, the sliding blocks and the curved energy storage part are made by integrated molding, and are made of a plastic or nylon material having better deformation restoration properties.
3. By arranging the channel grooves and the channel engagement housing, the stable slide of the sliding blocks can be realized.
4. By arranging the transmission disc, the third through hole, the second transmission teeth, and the second transmission slots, the upper cover can move up and down to realize clutch fit between the second transmission teeth and the second transmission slots, and then to realize clutch fit between the upper cover and the winding wheel; and by arranging the limiting structure, the upper cover can be in a stable state when the clutch fit between the upper cover and the winding wheel is realized. That is, when the upper cover drives the transmission disc to move downwards to be connected with the winding wheel, the second through hole is engaged in a lower end of the limiting protrusion, and when the upper cover drives the transmission disc to move upwards to be separated from the winding wheel, the second through hole is engaged in an upper end of the limiting protrusion. Thus, relatively stable clutch fit can be realized.
5. The lacing device based on the same inventive concept is additionally provided with the base and is further provided with the torsional spring and the rotating disc. By arranging the elastic sheets and the third transmission slots, when the upper cover drives the winding wheel to rotate forwards, the winding wheel does not drive the rotating disc to rotate, and during reverse rotation, the rotating disc can be driven to rotate reversely. In a lace fastening mode, the upper cover is connected and fitted with the winding wheel, and due to the existence of the ratchet mechanism, the upper cover can only rotate forwards to drive the winding wheel to fasten the lace, and can stop rotating to lock the lace; and in a lace releasing mode, the upper cover is disconnected with the winding wheel, the ratchet mechanism is out of fit, the lace can be drawn out and released to drive the winding wheel to rotate reversely, and then to drive the rotating disc to rotate, the torsional spring stores energy, the lace is released, and the torsional spring releases energy to drive the rotating disc to rotate forwards, and then to drive the winding wheel to rotate forwards, so that the lace can also be partially or entirely recycled in the releasing mode.

If the lacing device is used on a shoe, when the upper cover is disconnected with the winding wheel, a shoelace is still in a semi-fastened state due to the existence of the torsional spring, at the time, the semi-fastened state is not locked, the shoelace can freely stretch, a foot can be freely separated from the shoe, and when the shoe is worn for the second time, the shoelace is stretched and released with a hand so as to be penetrated. The stretched shoelace will be automatically taken back into the device, and then is locked by pressing, so that it is more convenient, time-saving and labor-saving during lacing the shoe for wearing.

Although the present invention has been specifically shown and introduced in conjunction with preferred embodiments, it should be understood by the skilled in the art that various changes in form and detail can be performed on the present invention without departing from the spirit and scope defined by the appended claims, and they shall fall within the protective scope of the present invention.

What is claimed is:

1. A lacing device, comprising an upper cover, a main body, a ratchet mechanism, a winding wheel, and a base, wherein the winding wheel is rotatably arranged in the main body, the upper cover and the winding wheel can be connected or separated; wherein the upper cover is provided with a first meshing surface;

when rotating in different directions, the winding wheel is capable of achieving two modes of lace fastening and lace releasing;

two or more slide channels are formed in an upper end surface of the main body, and each of the slide channels is composed of two stop block structures;

the ratchet mechanism is also located on the upper end surface of the main body and comprises two or more sliding blocks sliding along the slide channels and an elastic member used for pushing the sliding blocks to slide towards an outside of the main body, the elastic member is an annular body arranged above the main body, each sliding block is arranged on the annular body, a curved energy storage part used for strengthening elastic properties is arranged between two adjacent sliding blocks on the annular body, an intersection point is formed between a first side line of each sliding block in a clockwise direction and an outer circumference of the main body, the intersection point forms a main body connecting line with a center of the main body, an included angle formed by the first side line and the main body connecting line is 30° to 60°, and each sliding block is provided with a first ratchet tooth fitted with the first meshing surface to achieve engagement;

the base is provided with a mounting cavity, and the main body is detachably arranged on the base;

the mounting cavity is internally provided with a rotating disc;

the mounting cavity is further internally provided with a torsional spring, and the torsional spring comprises a first movable end that can be engaged and a second movable end that can be engaged meshed;

the first movable end is arranged on the base, and the second movable end is arranged on the rotating disc;

the rotating disc is provided with elastic sheets, and third transmission slots fitted with the elastic sheets are formed in a lower end surface of the winding wheel, so that the winding wheel is meshed in only one rotation direction; and when the upper cover is connected with the winding wheel, the first ratchet tooth is nested and engaged with the first meshing surface, when the upper cover rotates forwards, the first meshing surface presses against the first ratchet tooth to push the sliding blocks to slide along the slide channels, and then to press the elastic member to deform, finally, each ratchet tooth enters the next first meshing surface, and then, the winding wheel is driven to rotate to achieve the lace fastening mode; in the lace fastening mode, the winding wheel does not drive the rotating disc to rotate, a lace can be normally fastened, when the upper cover rotates reversely, the first meshing surface is locked by the first ratchet tooth so that the sliding blocks cannot be pushed to slide along the slide channels; when the upper cover is disconnected with the winding wheel, the first ratchet tooth is disconnected with the first meshing surface to enter the lace releasing mode, the lace can be drawn out, then, the winding wheel is driven to rotate reversely, and then, the torsional spring is driven to rotate for energy storage; at the time, the lace is released, the torsional spring releases energy to drive the rotating disc to rotate forwards, and then to drive the winding wheel to rotate forwards, and then, the lace can also be partially or entirely recycled under the lace releasing mode.

2. The lacing device of claim 1, wherein three sliding blocks are provided, and the three sliding blocks are uniformly spaced.

3. The lacing device of claim 1, wherein each stop block structure is further provided with a channel engagement housing used for engaging the sliding blocks.

4. The lacing device of claim 1, wherein two or more limiting clamping blocks are arranged on a lower end of the upper cover, a clamping ring is arranged on an upper part of a side surface of the main body, the limiting clamping blocks are engaged on a lower end of the clamping ring, a third through hole is formed in the middle of an upper end of the main body, a transmission disc is clamped in the middle of the upper cover, second transmission teeth are arranged on a lower end of the transmission disc, second transmission slots are formed in an upper end surface of the winding wheel, the upper cover moves up and down along the main body to realize clutch fit between the second transmission teeth and the second transmission slots, and then to realize clutch fit between the upper cover and the winding wheel, and the main body is provided with a limiting structure used for limiting an up-and-down movement position of the upper cover.

5. The lacing device of claim 4, wherein a first through hole is formed in the middle of the winding wheel, a second through hole is formed in the middle of the transmission disc, the limiting structure comprises a bottom plate and a clamping pin arranged in the middle of the bottom plate, the bottom plate is clamped on a lower end of the main body, the clamping pin penetrates through the first through hole and the second through hole, a limiting protrusion is arranged on the side wall on an upper end of the clamping pin, when the upper cover drives the transmission disc to move downwards to be connected with the winding wheel, the second through hole is engaged in a lower end of the limiting protrusion, and when the upper cover drives the transmission disc to move upwards to be separated from the winding wheel, the second through hole is engaged in an upper end of the limiting protrusion.

6. The lacing device of claim 5, wherein an elastic deformation slot is formed in the middle of the clamping pin, and when the limiting protrusion penetrates through the second through hole, the elastic deformation slot realizes penetration by deformation.

7. The lacing device of claim 1, wherein the rotating disc is provided with three elastic sheets, a disc wall is arranged downwards on a circumferential side surface of the rotating disc, the disc wall is provided with a notch used for engaging the second movable end of the torsional spring, and the torsional spring is located in the disc wall.

8. The lacing device of claim 1, wherein a mounting column is arranged in the middle of the base, the first movable end of the torsional spring is engaged on the mounting column, and the mounting column is provided with three engagement forks.

* * * * *